United States Patent [19]

Picault et al.

[11] Patent Number: 5,026,434

[45] Date of Patent: Jun. 25, 1991

[54] COPPER-IRON-COBALT-TITANIUM ALLOY WITH HIGH MECHANICAL AND ELECTRICAL CHARACTERISTICS AND ITS PRODUCTION PROCESS

[75] Inventors: Alain Picault, Mantes-la-Ville; Christian Gandossi, Séifontaine; Laurent Mineau, Grenoble, all of France

[73] Assignee: Trefimetaux, Courbevoie, France

[21] Appl. No.: 542,919

[22] Filed: Jun. 25, 1990

[30] Foreign Application Priority Data

Jul. 7, 1989 [FR] France ..... 89 09906

[51] Int. Cl.[5] ..... C22F 1/08; C22C 9/00

[52] U.S. Cl. ..... 148/2; 148/11.5 C; 148/12.7 C; 148/411; 148/432; 420/492; 420/496

[58] Field of Search ..... 148/11.5 C, 12,7 C, 148/13.2, 160, 411, 432, 2; 420/492, 496

[56] References Cited

U.S. PATENT DOCUMENTS 4,047,980 9/1977 Watson et al. ..... 148/411

4,734,255 3/1988 Duerrschnabel et al. ..... 420/492

*Primary Examiner*—R. Dean

*Assistant Examiner*—Robert R. Koehler

*Attorney, Agent, or Firm*—Dennison, Meserole, Pollack & Scheiner

[57] ABSTRACT

A process for producing a Cu-Fe-Co-Ti alloy useful as conductor elements in the electronics and connector industries. The alloy is produced in the form of a bath having a Ti/Fe+Co ratio between 0.3 and 1 and a Co/Fe ratio between 0.10 and 0.90. The molten alloy bath is deoxidized with boron, cast, homogenized, cold drawn, and subjected to a precipitation heat treatment at a temperature lower, by at most 80° C., than a temperature TM leading to the maximum electric conductivity.

12 Claims, 2 Drawing Sheets

COPPER-IRON-COBALT-TITANIUM ALLOY WITH HIGH MECHANICAL AND ELECTRICAL CHARACTERISTICS AND ITS PRODUCTION PROCESS

The present invention relates to a copper-iron-cobalt-titanium alloy and to its production process, as well as to its field of use.

Electrical interconnections have rapidly evolved. The size of parts carrying electric current continues to fall both in the electronics field (component support grids, contacts) and in the connector industry (clips, pole pieces, connectors). However, the complexity of shape of the contacts continues to increase.

Therefore the manufacturer of cuprous semifinished products and alloys is confronted with the challenge of increasing the electrical and thermal conductivity of traditional alloys in order to limit the heating of connectors and retain or improve the level of mechanical properties. The improvement to mechanical properties must obviously include the capacity of the alloy to be deformed in directions parallel and perpendicular to the rolling direction.

In the connector industry use is generally made of bronzes containing 4 to 9% tin having excellent mechanical properties and a deformability adapted to such applications. However, their electrical conductance, which varies from 12 to 20% IACS, is inadequate, because it limits the miniaturization of connectors due to the heating problem.

For electronics, e.g. in the field of support grids, use is generally made of copper-iron alloys (C19400), which have a conductivity of 65% IACS. However, the compromise between the mechanical properties and the softening behaviour means that these alloys cannot be used when the encapsulation temperatures are too high and exceed 400° C.

Except when indicated otherwise, all the alloy compositions in the present patent application are in percentages by weight.

A ternary alloy of copper with 2% nickel and 0.5% silicon having good mechanical properties has long been known (mechanical strength 600 MPa).

However, such an alloy has an electrical conductivity limited to 60% IACS due to the solubility of the $Ni_2Si$ precipitate. In addition, U.S. Pat. No. 4,559,200 describes the improvements resulting from small additions of magnesium or nickel to a CuFeTi alloy.

More recently Polish patent No. 115185 has disclosed a copper-iron-cobalt-titanium alloy, which covers a wide range of compositions. These alloys can reach a conductivity of 85% IACS for a tensile strength of 440 MPa. However, two heat treatments are required in order to achieve these properties.

Hitherto it has not been possible to economically produce an alloy having both high mechanical characteristics, typically a mechanical strength higher than 500 MPa and a high conductivity, greater than 80% IACS.

The invention relates to a copper alloy having a high mechanical strength, well above 500 MPa, a conductivity higher than 80% IACS, a good softening behaviour and relatively low production costs.

According to the invention these high performances are obtained by using three types of means at different stages of the procedure of producing the alloy and the semifinished products obtained therefrom. These are means relating to the composition of the alloy, the deoxidation of the liquid or molten alloy bath making it possible to avoid vacuum production and the precipitation temperature during the shaping of the alloy.

More specifically, the process according to the invention is characterized in that:

(1) the composition of the alloy satisfies the following conditions (weight composition):

Co/Fe ratio between 0.10 and 0.90,
Ti/(Fe+Co) ratio between 0.30 and 1,
iron content between 0.030 and 2%,
cobalt content between 0.025 and 1.8%,
titanium content between 0.025 and 4%,
oxygen content below 50 ppm,
content of metallic impurities below 0.1% with each of them below 0.015%, the residue being copper;

(2) the molten alloy bath is deoxidized with boron;

(3) the precipitation heat treatment is performed at a temperature below, by at the most 80° C., the precipitation treatment temperature TM leading to the maximum conductivity.

These three means will be described in detail and related to the prior art. By studying the properties of Cu-Fe-Co-Ti alloys of the prior art, the Applicant has found that the electrical conductivity varied considerably as a function of the Ti/(Fe+Co) ratio and in particular in an erratic manner, as is shown by FIG. 1 of example 1. Thus, it is not possible to select Cu-Fe-Co-Ti alloys having high electrical performance characteristics, despite respecting the Ti/(Fe+Co) ratio representing the stoichiometry of possible precipitates (FeTi, $Fe_2Ti$, Co Ti, $Co_2Ti$).

Continuing the analysis of the performance characteristics of these alloys, the Applicant was surprised to find that the Co/Fe ratio had a considerable influence on the electrical conductivity of these alloys. FIG. 2 of example 1 shows that this ratio is highly significant for expressing the variability of the electrical conductivity. The electrical conductivity is particularly high in the range where Co/Fe is between 0.1 and 0.9 and more particularly between 0.15 and 0.45. It should be noted that the electrical conductivity values of example 1 are to be considered in a relative and non-absolute manner, because the tests are laboratory selection tests, which do not necessarily exactly reproduce all the industrially usable means, which influences the absolute conductivity values.

Preferably, the compositions of iron, cobalt and titanium are respectively between 0.1 and 1%, between 0.05 and 0.4% and between 0.035 and 0.6%, whilst the residual oxygen content is preferably below 20 ppm.

It is the precipitation of a clearly defined compound, which is rich in iron and titanium and with cobalt, which gives the alloy its exceptional properties, i.e. mechanical strength, conductivity and shapability.

The obtaining of high performance alloys requires a deoxidation of the liquid alloy bath, in order more particularly to control the composition of the bath and prevent addition elements, in particular titanium, serving as a deoxidizing agent and being eliminated.

The composition is also well controlled by vacuum production, the oxygen content then being very low and generally below 0.0005%. However, due to the high costs, the Applicant has preferred conventional melting with deoxidation of the bath.

Thus, the Applicant has carried out semi-industrial tests with the deoxidation of the Cu-Fe-Co-Ti alloy bath of composition in accordance with the present invention. The Applicant has found that phosphorus, the deoxidizing agent frequently used in the prior art, did not lead to a very high performance alloy. In addition, various other deoxidizing agents were studied and compared (cf. example 2), namely phosphorus, magnesium and boron. The Applicant was surprised to find that boron led to higher performance alloys than those obtained with phosphorus or magnesium, although the latter, on the basis of thermodynamic data, is the most powerful deoxidizing agent of the three. Thus, it was found that on the one hand boron makes it possible to obtain a bath with a low residual oxygen content and on the other the boron oxide formed is easily eliminated from the bath, unlike other oxides, which avoids hard points of the alloy during high speed cutting. Finally, the residual boron content in the alloy is very low and is generally below 0.0005% (but still detectable). The consequence is a high conductivity level and a relatively low temperature TM, the latter being the precipitation treatment temperature leading to the maximum conductivity (cf. FIG. 3 of example 2). Finally, it should be noted that the greatest dispersion fineness of the precipitates occurs in the case of boron deoxidation.

The precipitation treatment is inserted in the alloy transformation phase comprising, following the casting of the alloy, its homogenization between 800° and 1000° C. for between 0.1 and 10 hours, its hot rolling up to 650° C., followed by an optional hardening which can vary between 20° C. and 2000° C./min and cold rolling with one or more intermediate annealings. However, the excellent cold deformability of the alloy according to the invention generally permits its shaping with only one thermal precipitation treatment, which constitutes a significant economy.

The electrical conductivity and mechanical characteristics of the semi-finished products obtained are also dependent on the transformation phase and particularly the thermal precipitation treatment.

With regards to the conductivity, FIG. 3 of example 2 shows that the conductivity passes through a maximum for a precipitation temperature TM (TM=515° C. for test C) and that said maximum has a flattened shape. The conductivity remains high for a wide temperature range between 475° and 550° C. for test C and in this range the gradient of the curve giving the conductivity as a function of the temperature is low and below 0.2% IACS/°C.

The Applicant found that, contrary to what might have been assumed, it is advantageous for the alloy according to the invention to undergo a precipitation treatment at a temperature below TM. In this case, for a minimum electrical conductivity loss, there is a very significant increase in the mechanical characteristics.

Thus, the comparison of examples 2 and 3 (tests C and C') shows that the conductivity passes from 83.5 to 83% IACS (−1%), whereas the mechanical strength rises from 488 to 525 MPa (+7.6%).

The term temperature below TM means any temperature corresponding to the desired conductivity level (>80% IACS). The graphic determination (cf. FIG. 3) is immediate. The intersection of the ordinate 80% IACS with the curve C determines the minimum temperature Tm.

According to the invention, the precipitation treatment takes place at a temperature between TM and Tm and preferably close to the latter in order to obtain the "balanced" properties according to the invention: % IACS>80 and Rm>500 MPa. Generally, Tm is at the most lower by 80° C. than TM. Another method for defining Tm is to consider the gradient of the slope %IACS as a function of the temperature, Tm corresponding to the temperature where the gradient starts to significantly increase and e.g. reaches the value 0.3% IACS/°C. It is the slope change zone which is preferred.

Example 3 shows that only the alloy according to the invention (test C') has both high conductivity and mechanical properties, but note should be taken of the interest of such a treatment for greatly increasing the mechanical characteristics of other alloys (tests A' and B') when the average conductivities (about 70% IACS) are adequate.

In more general terms, a "low temperature" precipitation treatment at between 350° and 550° C. will give a maximum mechanical strength (tests A' and B'), whereas a "high temperature" treatment at between 450° and 650° C. will tend rather to lead to a maximum conductivity, the common range between 450° and 550° C. being that where the mechanical properties and conductivity are "balanced".

The duration of the precipitation treatments varies as a function of the technology used, namely from 1 to 10 hours in the static furnace and 10 seconds to 30 minutes in the passage furnace.

On the basis of the alloy according to the invention, it is possible to reinforce the mechanical properties by adding to the basic composition elements such as aluminium, tin, zinc, nickel, silver, chromium, beryllium and rare earths. The total sum of these elements must be below 1.5% if it is wished to maintain an adequate conductivity. These addition elements generally reduce the electrical conductivity and only constitute a secondary modality of the invention.

The invention shows that only the combination of particular means constituted by the composition of the alloy with a precise ratio Co/Fe, the particular choice of deoxidizing agent and a temperature range for the precipitation treatment, makes it possible both to obtain a high electrical conductivity and a high mechanical strength. Example 4 illustrates the "standard" properties of the prior art alloys. When they have a high electrical conductivity, their mechanical strength is low and vice versa. It clearly shows the advantageous performance characteristics of the product obtained according to the invention.

As has already been stated, the production range of alloys according to the invention is particularly economic, because high cold drawing levels can be reached with a single heat treatment, i.e. the precipitation heat treatment.

The alloys according to the invention are suitable for applications simultaneously requiring high mechanical strength and conductivity. They are recommended for the production of conductor elements in electronics and in the connector industry and in particular for applications such as lead-frames, contact springs and connections.

DESCRIPTION OF THE DRAWINGS AND EXAMPLES

Figure 4:
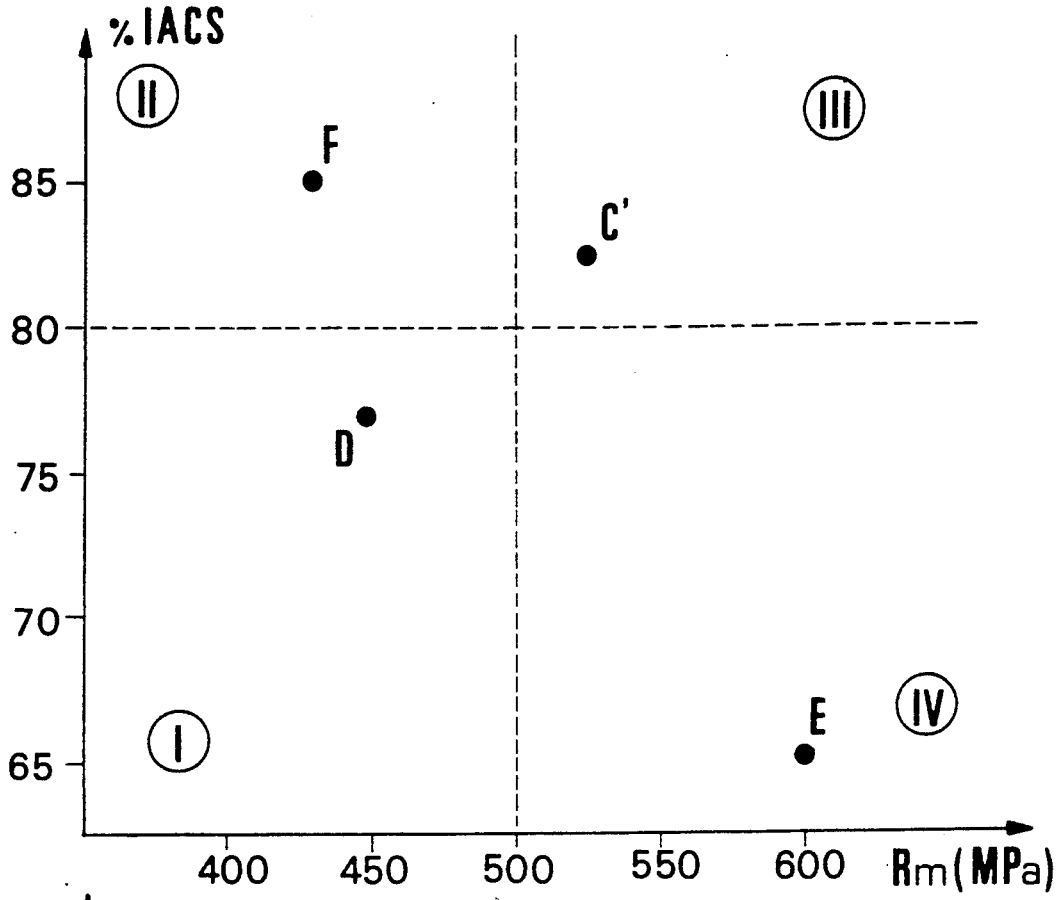

FIG. 4 illustrates, on a graph having on the abscissa the mechanical strength in MPa and on the ordinate the electrical conductivity in % IACS, the performance characteristics of the alloy obtained according to the invention (C'), according to Polish patent No. 115185 (D and F) and according to U.S. Pat. No. 4,559,200 (E), as indicated in example 4. The zone (III) where the alloy obtained according to the invention is located is that of alloys having high mechanical characteristics and electrical conductivity characteristics at the same time.

EXAMPLE 1

This example studies the influence of the composition of the alloy on the electrical conductivity.

Seven Cu-Fe-Co-Ti alloys, designated R1 to R7, were produced in the laboratory by melting pure elements (Cu C2 Fe electrolytic, Co electrolytic, Ti 140 supplied by CEZUS) in an induction furnace-heated boron nitride crucible. Melting was carried out under argon at atmospheric pressure. These laboratory conditions make it possible to produce Cu-Fe-Co-Ti alloys, without it being necessary to deoxidize the bath, so as to obtain results essentially depending on the composition of the alloy.

Table 1 indicates the composition of these alloys.

TABLE 1

| ALLOY REFERENCE | WEIGHT CONTENT % Fe | % Co | % Ti | % Cu | Co/Fe |
|---|---|---|---|---|---|
| R 1 | 0.84 | 0 | 0.28 | complement to 100 | 0 |
| R 2 | 0.66 | 0.18 | 0.32 | complement to 100 | 0.27 |
| R 3 | 0.35 | 0.35 | 0.25 | complement to 100 | 1 |
| R 4 | 0.21 | 0.51 | 0.28 | complement to 100 | 2.4 |
| R 5 | 0.31 | 0.09 | 0.29 | complement to 100 | 0.29 |
| R 6 | 0.22 | 0.19 | 0.28 | complement to 100 | 0.86 |
| R 7 | 0.11 | 0.27 | 0.28 | complement to 100 | 2.45 |

The molten metal is cast into a water-cooled, copper ingot mould making it possible to cast billets with an approximate diameter of 16 mm for a height of 100 mm, i.e. an approximate charge of 180 g.

Parallelepipedic 3×3×50 mm samples were then cut from ingots. The different thermal and mechanical treatments were performed on these bars or strips:

(a) homogenization:

The crude casting samples, enveloped in a molybdenum sheet, were enclosed in a vacuum quartz envelope. The latter was then placed in the core of a steel block heated by a resistance furnace to the treatment temperature of 920° C. After maintaining this temperature for 2 hours, the envelope was broken in a water tank.

(b) cold drawing:

The alloys were cold rolled following the homogenization treatment. The cold rolling level applied is approximately 80%, i.e. a final strip thickness of 0.5 mm, obtained in about ten successive passes.

(c) precipitation:

The samples are heated in a resistance furnace under atmospheric argon pressure under the following conditions: heating from ambient temperature to 200° C., maintaining said temperature for 1 hour, raising the precipitation temperature at a rate of 200° C./hour and then maintaining the precipitation temperature for 1 hour, followed by cooling at 400° C./hour.

The following table 2 indicates the conductivity of each alloy expressed in % IACS and measured at ambient temperature, as a function of the precipitation temperature.

TABLE 2

| ALLOY REFERENCE | PRECIPITATION TEMPERATURE 400° C. | 500° C. | 530° C. | 560° C. | 600° C. |
|---|---|---|---|---|---|
| R 1 | | 61.4 | 62.7 | 62.8 | 56 |
| R 2 | 49 | 63.6 | 71.7 | 77.7 | 77.4 |
| R 3 | | 60.3 | 65 | 65.7 | 63 |
| R 4 | 44 | 58.5 | 60.7 | 61.0 | 60.8 |
| R 5 | 39.7 | 64 | 71.5 | 76.1 | 73.3 |
| R 6 | 44.5 | 65 | 74.2 | 74.6 | 75.3 |
| R 7 | 44.4 | 62 | 65.6 | 67.6 | 63 |

Table 2 shows that the maximum conductivity values, expressed in %IACS and underlined in the table, are obtained for a precipitation temperature close to 560° C. and that these maximum values are highly dispersed.

Figure 1:
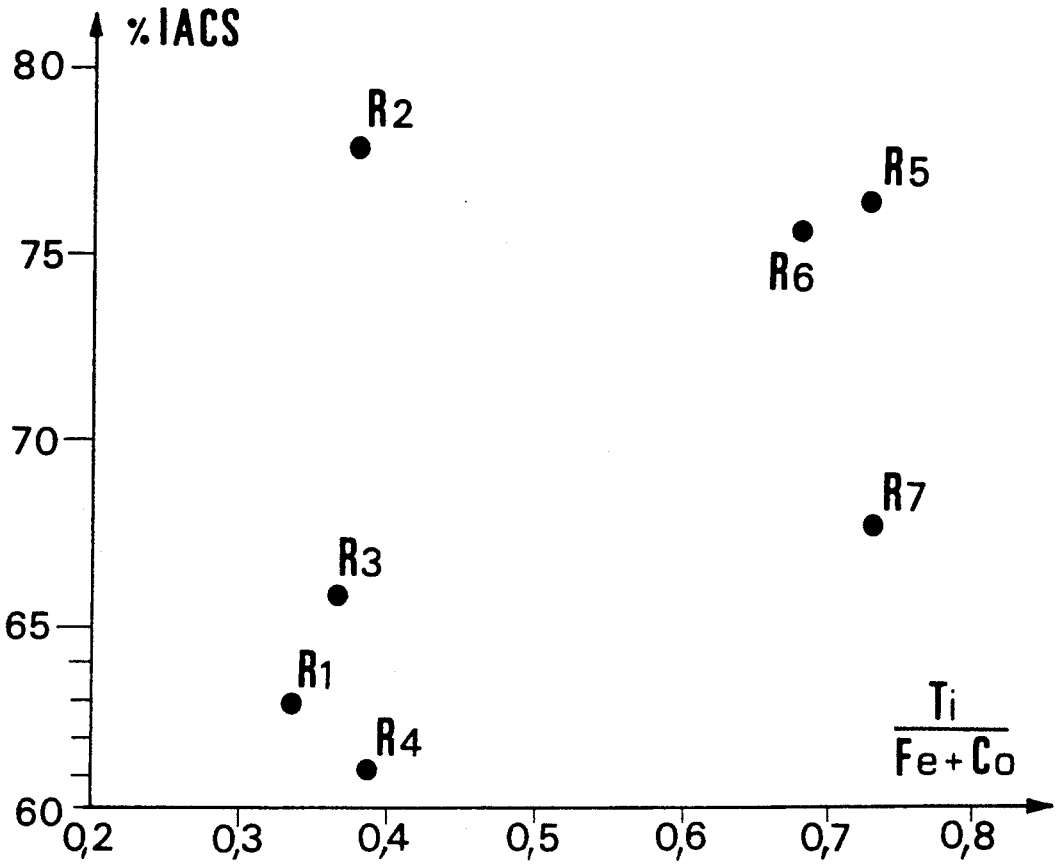
FIG. 1 illustrates, on a graph having the Ti/(Fe+Co) ratio on the abscissa and the electrical conductivity in % IACS on the ordinate, the results obtained for 7 tests designated R1 to R7 and described in example 1.

The analysis of these results according to the prior art criterion (Ti/(Fe+Co) ratio) of Polish patent No. 115185 shows that on the one hand in the range 0.25–1 for Ti/(Fe+Co) claimed for this ratio, there is a considerable conductivity variation for values which are close together (comparison of tests R1, R2, R3, R4 and tests R5, R6, R7) and that said ratio Ti/(Fe+Co) does not make it possible to determine the favourable high conductivity range, because the seven representative points do not make it possible to plot a curve having a clear maximum (cf. FIG. 1).

Figure 2:
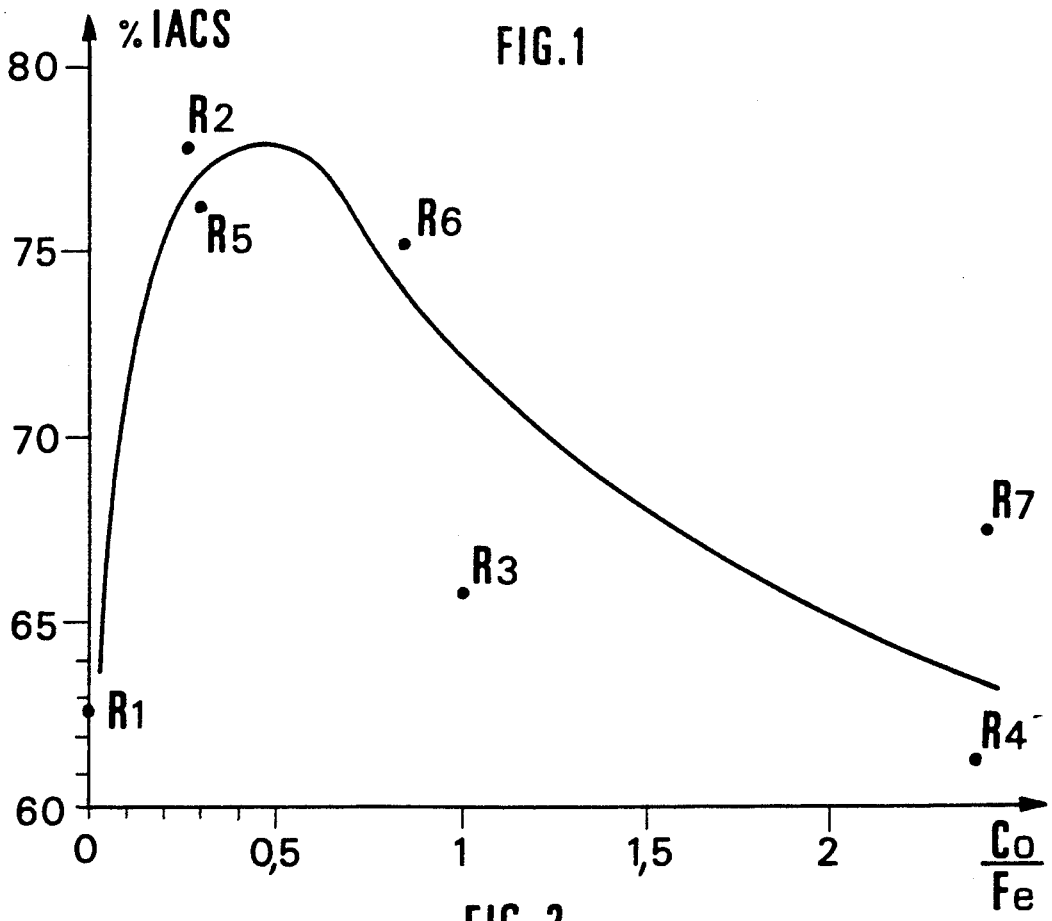
FIG. 2 illustrates, on a graph having on the abscissa the Co/Fe ratio and on the ordinate the electrical conductivity in % IACS, the results obtained for 7 tests, designated R1 to R7 and described in example 1, which permit the plotting of a curve.

However, the analysis of these results according to the criterion found by the Applicant (the ratio Co/Fe) makes it possible, as shown in FIG. 2, to select high conductivity alloys when said ration Co/Fe is between 0.1 and 0.9 and preferably between 0.15 and 0.45.

EXAMPLE 2

This example studies, under conditions close to industrial conditions, the influence of the deoxidation method of the bath by carrying out three tests with a similar Co/Fe ratio and differing by the choice of the deoxidizing agent, namely magnesium (test A), phosphorus (test B) and boron (test C).

These three deoxidizing agents are introduced into the molten bath so as to neutralize the same oxygen quantity:

$$Mg+\tfrac{1}{2}O_2 \rightarrow MgO$$

$$\tfrac{2}{3}B+\tfrac{1}{2}O_2 \rightarrow \tfrac{1}{3}B_2O_3$$

$$2/5P+\tfrac{1}{2}O_2 \rightarrow 1/5P_2O_5$$

Bearing in mind the atomic masses of magnesium, phosphorus and boron and on the basis of a 0.06% Mg quantity, it is necessary to have 0.03% P and 0.018% B for neutralizing the same oxygen quantity.

In an induction furnace with a 10 kg useful capacity, melting takes place at 1250° C. in a graphite crucible of the copper, iron and cobalt, the two latter being in the form of mother or parent alloys. This is followed by the addition of the boron or phosphorus or magnesium and titanium, also in mother alloy form, followed by degassing. Table 3 indicates the composition of the charge for each test:

TABLE 3

| | Fe | Co | Ti | B | P | Mg |
|---|---|---|---|---|---|---|
| TEST A | 0.49% | 0.09% | 0.42% | — | — | 0.06% |
| TEST B | 0.42% | 0.11% | 0.33% | — | 0.025% | — |
| TEST C | 0.51% | 0.12% | 0.28% | 0.0150 | — | — |

Figure 3:
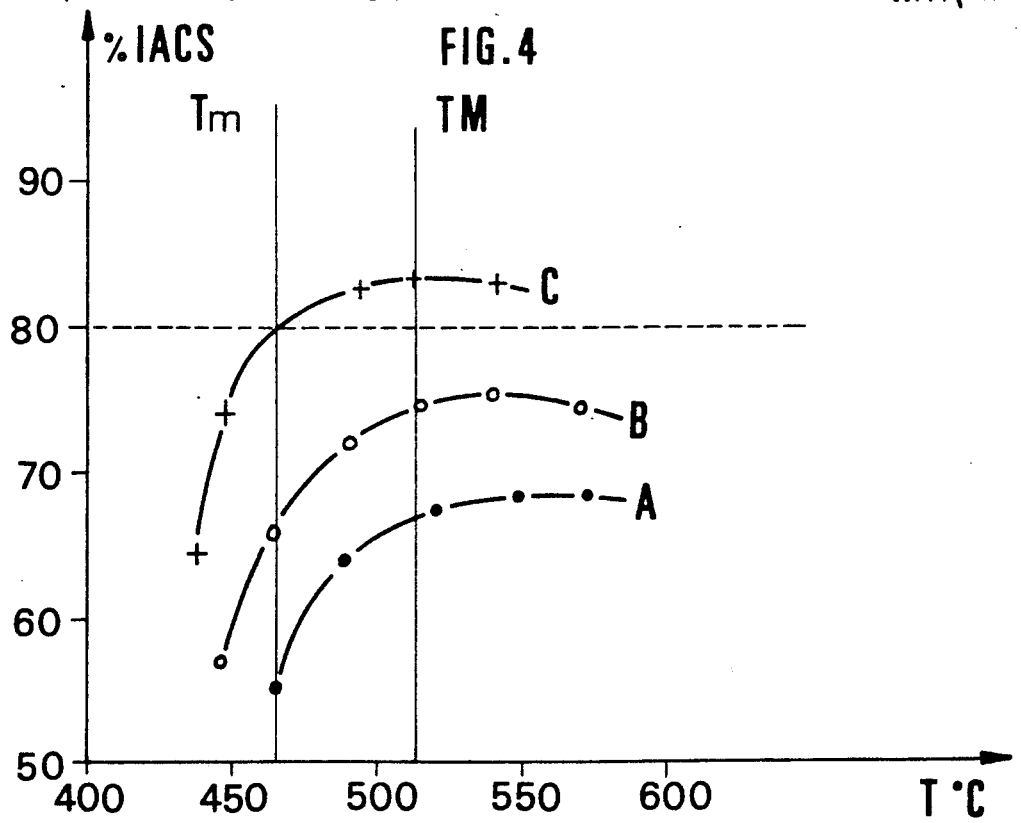
FIG. 3 illustrates, on a graph having on the abscissa the temperature in °C. and on the ordinate the electrical conductivity in % IACS, the electrical conductivity variations as a function of the precipitation treatment temperature for each of the three deoxidizing agents studied in example 2, namely in magnesium (curve A), phosphorus (curve B) and boron (curve C).

During all these operations, the bath is covered with wood charcoal. Casting takes place at approximately 1200° C. The plates are then homogenized at 920° C. for 2 hours and then hot rolled in several passes. Following the final pass, they are hardened in water at approximately 700° C. After milling to 9 mm, the plates are cold rolled without intermediate annealing until 0.8 mm thick strips are obtained. The alloys then undergo a precipitation treatment for 4 hours at the following temperature TM between 500° and 600° C., which leads to the optimum conductivity (cf. FIG. 3):

Test A: 575° C.

Test B: 535° C.

Test C: 515° C.

This heat treatment is followed by a final rolling with a 44% thickness reduction.

Alloys with the following characteristics are obtained:

TABLE 4

| | RESIDUAL DEOXIDIZING AGENT CONCENTRATION (in %) | RESIDUAL $O_2$ CONCENTRATION (in %) |
|---|---|---|
| Test A | 0.0270 | 0.0014 |
| Test B | 0.0100 | <0.0005 |
| Test C | <0.0005 | <0.0005 |

The following mechanical and conductivity properties are obtained:

TABLE 5

| | CONDUCTIVITY (% IACS) | MECHANICAL STRENGTH (MPa) | 90° BENDING r/e |
|---|---|---|---|
| Test A | 68.5 | 492 | 0 |
| Test B | 75.5 | 471 | 0 |
| Test C | 83.5 | 488 | 0 |

EXAMPLE 3

This example illustrates a variant of the shaping of alloys produced as in example 2 (test A' of example 3 corresponding to test A of example 2, as for B' and C'), except that the precipitation treatment takes place at a lower temperature (505° C. for A', 485° C. for B' and 475° C. for C') for 4 hours and that the final rolling corresponds to a 29% thickness reduction.

The following properties are obtained:

TABLE 6

| | CONDUCTIVITY (% IACS) | MECHANICAL STRENGTH (MPa) | 90° BENDING r/e |
|---|---|---|---|
| Test A' | 65.5 | 583 | 0 |
| Test B' | 69.5 | 565 | 0 |
| Test C' | 83 | 525 | 0 |

These alloys have a hardness exceeding 130 HV after maintaining at 450° C. for 30 minutes, which illustrates their excellent softening resistance.

EXAMPLE 4

This example compares the invention with the prior art for a transformation range only having a single heat treatment (precipitation annealing):

Test C': example 3

Test D: according to Polish patent No. 115185

Test E: according to U.S. Pat. No. 4,559,200

FIG. 4 locates these tests in a plan having the mechanical strength on the abscissa and the electrical conductivity on the ordinate and clearly illustrates the interest of the invention.

The non-comparative test F is given for information purposes. It corresponds to test D, but with a transformation range involving two heat treatments instead of one.

What is claimed is:

1. Process for the production of a Cu-Fe-Co-Ti alloy including a step of producing the alloy and a step of alloy transformation with a precipitation heat treatment, comprising:
   (a) preparing a molten alloy bath having a composition which satisfies the following conditions, by weight:
   Co/Fe ratio between 0.10 and 0.90;
   Ti/(Fe+Co) ratio between 0.30 and 1;
   iron content between 0.030 and 2%;
   cobalt content between 0.025 and 1.8%;
   titanium content between 0.025 and 4%;
   oxygen content below 50 ppm;
   content of metallic impurities below 0.1% with each impurity below 0.015%; the remainder being copper;
   (b) deoxidizing the molten alloy bath by introducing boron therein and eliminating the boron oxide formed;
   (c) casting the molten alloy, then homogenizing, cold drawing, and subjecting the cold drawn alloy to a precipitation heat treatment, with the precipitation heat treatment at a temperature lower, by at the most 80° C., than a temperature TM leading to the maximum electrical conductivity.

2. Process according to claim 1, wherein the Co/Fe ratio is between 0.15 and 0.45.

3. Process according to claim 2, wherein the oxygen content is below 20 ppm.

4. Process according to claim 2, wherein the iron content is between 0.1 and 1%.

5. Process according to claim 2, wherein the cobalt content is between 0.05 and 0.4%.

6. Process according to claim 2, wherein the titanium content is between 0.035 and 0.6%.

7. Process according to claim 2, wherein the titanium is introduced in mother alloy form following the introduction of the boron, so as to avoid titanium losses and obviate melting and vacuum casting.

8. Process according to claim 2, wherein the precipitation heat treatment is carried out at a temperature, below the temperature TM, for which the gradient of the conductivity curve in % IACS as a function of the temperature is between 0.1 and 0.3% IACS/°C.

9. Alloy obtained according to claim 1, 2, 3, 4, 5, 6, 7 or 8.

10. Alloy according to claim 9, containing less than 10 ppm boron.

11. Alloy according to claim 9, in the form of a conductor element for the electronics or connector industries.

12. Alloy according to claim 11, wherein said conductor element is a component support grid, contact spring or connector.

* * * * *